US008113606B2

(12) United States Patent
Greenberg

(10) Patent No.: US 8,113,606 B2
(45) Date of Patent: Feb. 14, 2012

(54) METHOD AND APPARATUS FOR OPTIMIZING STORAGE SPACE

(76) Inventor: Bertram M. Greenberg, New York, NY (US)

( * ) Notice: Subject to any disclaimer, the term of this patent is extended or adjusted under 35 U.S.C. 154(b) by 639 days.

(21) Appl. No.: 12/252,500

(22) Filed: Oct. 16, 2008

(65) Prior Publication Data

US 2009/0179538 A1 Jul. 16, 2009

Related U.S. Application Data

(63) Continuation-in-part of application No. 12/238,161, filed on Sep. 25, 2008, now abandoned, which is a continuation of application No. 11/113,382, filed on Apr. 23, 2005, now abandoned.

(60) Provisional application No. 60/960,830, filed on Oct. 16, 2007.

(51) Int. Cl.
*A47B 81/00* (2006.01)

(52) U.S. Cl. ..... 312/271; 312/306; 312/311

(58) Field of Classification Search ..... 312/107, 312/108, 111, 306, 312, 249.8, 249.11–249.13, 312/291, 311, 271–276
See application file for complete search history.

(56) References Cited

U.S. PATENT DOCUMENTS

| | | | | |
|---|---|---|---|---|
| 363,595 A | | 5/1887 | C'laus | |
| 398,188 A | * | 2/1889 | Rittinger et al. | 312/306 |
| 700,174 A | * | 5/1902 | Copeland | 312/233 |
| 730,046 A | | 6/1903 | Price | |
| 791,507 A | * | 6/1905 | Snively | 160/190 |
| 791,512 A | * | 6/1905 | Thomas | 312/310 |
| 973,573 A | | 10/1910 | Sims | |
| 1,425,259 A | | 8/1922 | Thomas | |
| 1,583,971 A | | 5/1926 | Hammond et al. | |
| 1,644,716 A | | 10/1927 | Fain | |
| 1,798,800 A | | 3/1931 | MacKnight | |
| 1,854,756 A | | 4/1932 | Muller | |
| 2,375,581 A | | 5/1945 | Pezzano | |
| 2,499,791 A | * | 3/1950 | Spencer | 312/247 |
| 2,563,988 A | * | 8/1951 | Conrad | 312/272 |
| 2,634,186 A | | 4/1953 | Zuss | |
| 2,915,192 A | | 12/1959 | Roma | |
| 3,285,682 A | | 11/1966 | Nelson | |

(Continued)

FOREIGN PATENT DOCUMENTS

GB 2223670 A 4/1990

(Continued)

OTHER PUBLICATIONS

"Southern Home Comforts" http://www.southernhomecomforts.com/store/downrods.asp, available Oct. 2004, accessed Aug. 20, 2007.

(Continued)

*Primary Examiner* — Janet M Wilkens
(74) *Attorney, Agent, or Firm* — Blank Rome LLP

(57) ABSTRACT

An adaptable furniture system includes a frame having an upper portion and a lower portion; at least one upper article of furniture located in the upper portion of the frame; at least one lower article of furniture located in the lower portion of the frame and underneath the at least one upper article; a moving system attached to the frame and the at least one upper article for moving the at least one upper article vertically within the frame; and a sliding system attached the at least one lower article to the frame for moving the at least one lower article forward and backward.

1 Claim, 11 Drawing Sheets

U.S. PATENT DOCUMENTS

| | | | | | |
|---|---|---|---|---|---|
| 3,361,510 | A | * | 1/1968 | McDermott | 312/312 |
| 3,379,482 | A | | 4/1968 | Baggott | |
| 3,734,588 | A | | 5/1973 | Ellis | |
| 3,768,676 | A | | 10/1973 | Spitzer | |
| 3,975,871 | A | | 8/1976 | Ghionda | |
| 4,082,250 | A | | 4/1978 | Allmon et al. | |
| 4,103,373 | A | | 8/1978 | Luedtke et al. | |
| 4,337,988 | A | | 7/1982 | Schenck | |
| 4,345,802 | A | | 8/1982 | Sorensen | |
| 4,412,601 | A | | 11/1983 | Cooper | |
| 4,859,008 | A | | 8/1989 | Eyre et al. | |
| 4,862,764 | A | | 9/1989 | Gehring | |
| 5,076,649 | A | * | 12/1991 | Therkelsen | 312/246 |
| 5,096,275 | A | * | 3/1992 | Pappas | 312/312 |
| 5,147,120 | A | | 9/1992 | Ray | |
| 5,199,843 | A | | 4/1993 | Sferra | |
| 5,242,217 | A | | 9/1993 | Gonnet | |
| 5,249,858 | A | | 10/1993 | Nusser | |
| 5,273,352 | A | | 12/1993 | Saper | |
| 5,296,791 | A | | 3/1994 | Hipp | |
| 5,475,949 | A | | 12/1995 | McCoy | |
| 5,507,570 | A | | 4/1996 | Williams et al. | |
| 5,857,756 | A | | 1/1999 | Fehre | |
| 5,871,070 | A | | 2/1999 | Contreras | |
| 6,048,044 | A | | 4/2000 | Biggel et al. | |
| 6,135,032 | A | | 10/2000 | Ko | |
| 6,250,728 | B1 | | 6/2001 | Thorp | |
| 6,425,151 | B2 | | 7/2002 | Barnett | |
| 6,471,311 | B1 | * | 10/2002 | Snyder | 312/247 |
| 6,484,893 | B1 | | 11/2002 | Tkatch | |
| 6,547,183 | B2 | | 4/2003 | Farnsworth | |
| D480,892 | S | | 10/2003 | White | |
| 6,663,336 | B2 | | 12/2003 | Fletcher et al. | |
| 6,676,233 | B1 | | 1/2004 | Evans et al. | |
| 6,752,475 | B2 | | 6/2004 | Steadman | |
| 6,755,492 | B1 | | 6/2004 | Hyde et al. | |
| 6,829,791 | B2 | | 12/2004 | Roepke | |
| 2002/0178497 | A1 | | 12/2002 | Thurston | |
| 2004/0027037 | A1 | | 2/2004 | Krueger | |
| 2006/0238085 | A1 | | 10/2006 | Greenberg | |
| 2007/0236116 | A1 | * | 10/2007 | Sweet et al. | 312/312 |
| 2009/0021128 | A1 | | 1/2009 | Greenberg | |

FOREIGN PATENT DOCUMENTS

| | | | |
|---|---|---|---|
| JP | 2001245733 | * | 9/2001 |

OTHER PUBLICATIONS

"Hale Bookcases" http://www.biz2bizonline.com/hale/index.html, available Feb. 2005, accessed Aug. 20, 2007.

* cited by examiner

METHOD AND APPARATUS FOR OPTIMIZING STORAGE SPACE

CROSS-REFERENCE TO RELATED APPLICATIONS

This application claims priority to U.S. Provisional Patent Application Ser. No. 60/960,830, filed Oct. 16, 2007, the contents of which are incorporated herein by reference.

This application is a Continuation-In-Part of U.S. patent application Ser. No. 12/238,161, filed Sep. 25, 2008 now abandoned, which is a Continuation of U.S. patent application Ser. No. 11/113,382, filed Apr. 23, 2005 now abandoned, the contents of which are incorporated herein by reference.

FIELD OF THE INVENTION

The present invention relates to a furniture system. More particularly, the present invention relates to a furniture system having optimized storage space.

BACKGROUND OF THE INVENTION

More and more, people are forced to inhabit increasingly small spaces. As a result, it is difficult to find sufficient storage space for their belongings. Much of the available storage space is usually the space right below the ceiling. This space remains unusable without a ladder due to the limitations of the human frame. The ladder requires balance and/or support, both of which are challenged when replacing or removing an object from this upper area.

SUMMARY OF THE INVENTION

In light of the difficulties of the background art, the inventor developed the present invention. To this end, a first non-limiting aspect of the invention provides an adaptable furniture system, which includes: At least one first article of furniture; at least one second article of furniture; at least one third article of furniture; and means for moving at least one of the at least one second article of furniture and the at least one third article of furniture, wherein the at least one first article of furniture is adapted to receive the at least one second article of furniture and the at least one third article of furniture, and wherein the at least one second article of furniture and the at least one third article of furniture are adapted to interchangeably occupy a space within the at least one first article of furniture.

The present invention also provides a non-limiting furniture system, including a frame having an upper portion and a lower portion; at least one upper article of furniture located in the upper portion of the frame; at least one lower article of furniture located in the lower portion of the frame and underneath the at least one upper article; a moving system attached to the frame and the at least one upper article for moving the at least one upper article vertically within the frame; and a sliding system attached the at least one lower article to the frame for moving the at least one lower article forward and backward.

A method for manufacturing a furniture system is provided. The method includes the steps of: providing a frame having an upper portion and a lower portion; providing at least one upper article of furniture located in the upper portion of the frame; providing at least one lower article of furniture located in the lower portion of the frame and underneath the upper article; providing a moving system attached to the frame and the upper article for moving the upper article vertically within the frame; and providing a sliding system attached to the frame and the lower article for moving the lower article forward and backward; wherein a forward movement of the second article enables the upper cabinet to move from the upper portion to the lower portion of the frame.

DETAILED DESCRIPTION OF THE PREFERRED EMBODIMENTS

As a general rule, 33 inches is the maximum distance an average sized person can reach forward from their toe point onto, or across to, a shelf at a shoulder height with a minimum of bending and twisting. Additionally, 54 inches is the maximum height of a drawer that allows a user to be able to see and reach down into it. The maximum height of a shelf for most users is 68 inches from the floor. Thus, in a room with a ten-foot ceiling, approximately an additional 48 inches of vertical space immediately below the ceiling remain unused because it cannot be accessed without a ladder. Each of the following embodiments maximizes the advantages made available by the 33, 54, and 68 inch rules, while eliminating the need for a ladder. The present invention improves the safety and ease of use of additional storage areas (e.g., 4 feet directly below the ceiling). When used in a room with a ceiling between 8 and 10 feet high, this invention provides safe and easy access to approximately 50% of the storage space in an average home, office, or storage area.

A detailed description of non-limiting embodiments of the invention will now be described with reference to the drawings, in which like numerals represent like elements throughout. Through the present invention, it is possible to maximize the amount of available storage space.

Figure 1:
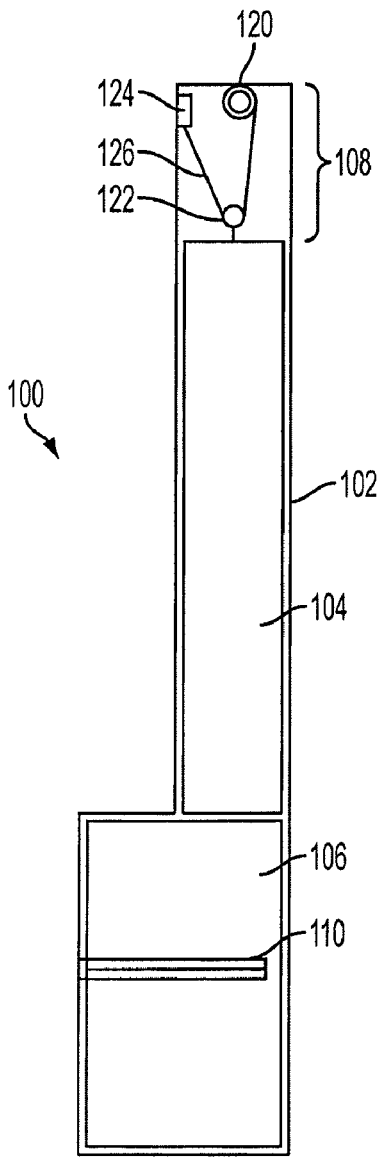
FIG. 1 is a side view of an adaptable furniture system according to a non-limiting exemplary embodiment of the present invention.

FIG. 1 shows a side view of an adaptable furniture system 100 according to an exemplary embodiment of the present invention. The furniture system 100 includes, among others, a frame 102, an upper cabinet 104, a lower cabinet 106, a moving system 108 and a sliding system 110. The frame 102 has an upper portion for receiving the upper cabinet 104 and a lower portion for receiving the lower cabinet 106. The moving system 108 may be attached to the frame 102 and the upper cabinet 104 for moving the upper cabinet up and down within the frame 102. The sliding system 110 may be attached to the frame 102 and the lower cabinet 106 such that the lower cabinet 106 may be easily moved forward or backward with respect to the frame 102.

Figure 2:
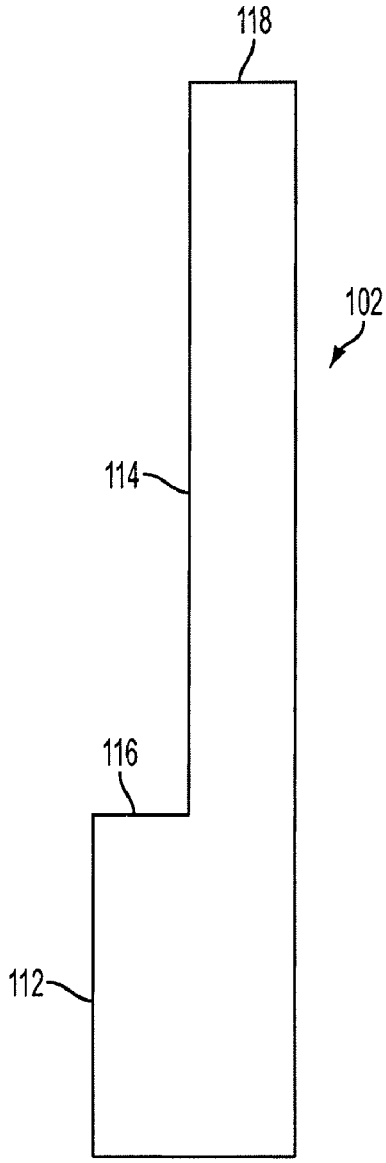
FIG. 2 is a side view of the frame of the furniture system of FIG. 1.

The frame 102, as shown in FIG. 2, includes front surfaces 112 and 114 as well as horizontal surfaces 116 and 118. The upper surface 118 of the frame 102 may be built as high as the ceiling of the room where the furniture system is located. The surfaces 116 and 118 may also be used for additional storage, if desired. If the upper surface 118 is used for additional storage, it may be built at a height lower than the height of the ceiling. To fully utilize the storage space right under the ceiling of a room, the upper surface 118 is preferably equal to or higher than 68 inches from the floor.

The frame 102 may be made from any suitable material. For example, the frame 102 may be made of wood, composite, polymers, or any other suitable materials known to those of skill in the art. As an option, the frame 102 may include interior or exterior supports to further strengthen the frame. The supports may be made from any suitable material, such as metal, wood, plastic, polymer, or the like, and may be adapted to appear as decorative features.

The front surfaces 112 and 114 may include decorative features (not shown). Additionally, the front surfaces 112 and 114 may include doors (not shown), which may be used to access the contents of the frame 102. The frame 102 may also include adaptable back surfaces (not shown), if desired.

Figure 3A:
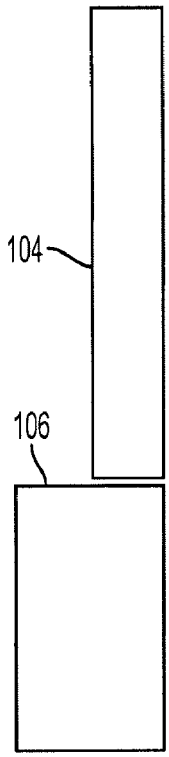
FIGS. 3(*a*)-3(*c*) illustrate various positions of the upper and lower cabinets inside the furniture system 100 of FIG. 1.
Figure 3B:
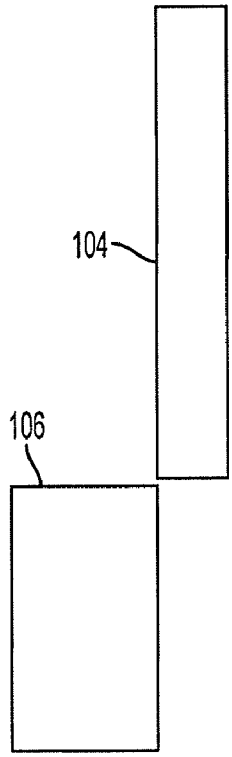
Figure 3C:
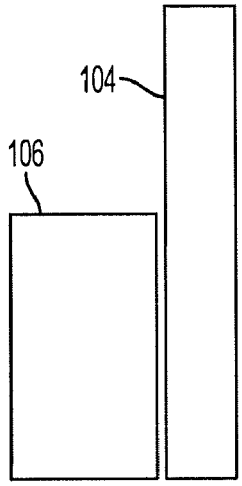

The upper cabinet 104 and the lower cabinet 106 are shown in FIGS. 3(*a*)-3(*c*) without the frame 102. In FIG. 3(*a*), the upper cabinet 104 and the lower cabinet 106 are in their fully retracted position inside the frame 102 where the upper cabinet 104 rests on top of the lower cabinet 106. As shown in FIG. 3(*a*), the lower cabinet 106 has greater depth than the upper cabinet 104. However, the depth of the upper cabinet 104 may also be equal to or greater than that of the lower cabinet 106.

In FIG. 3(*b*), the lower cabinet 106 is pulled forward to create a space within the frame 102 behind the lower cabinet 106. A portion or all of the upper cabinet 104 may then be lowered, as shown in FIG. 3(*c*).

Referring again to FIG. 1, the moving system 108 for lowering and raising the upper cabinet 104 may include a winch device 120, a leverage element 122, a securing anchor 124 and a cable 126. The winch device 120 and the securing anchor 124 are attached to the frame 102. The leverage element 122 is attached to the upper cabinet 104. The cable 126 is secured at one end to the winch device 120 and at another end to the securing anchor 124. A middle section of the cable 126 is movably attached to the leverage element 122 for supporting and suspending the upper cabinet 104. The securing anchor 124 may include a bracket, hook, clamp, or other suitable devices for securing known to those of skill in the art.

Figure 4:
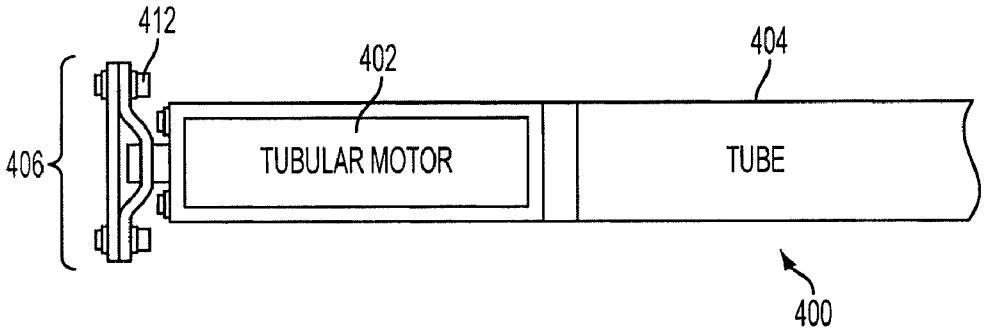
FIG. 4 is an exemplary winch system according to a non-limiting aspect of the present invention.

The winch device 120 may incorporate any devices for raising and lowering heavy objects known to those of skill in the art. For example, the winch device 120 may include motor elements, as depicted in FIG. 4.

The leverage element 122 may be detachably or permanently attached to a top surface of the upper cabinet 104. In the exemplary embodiment of FIG. 1, the leverage element 122 includes a pulley. Of course, other leverage elements, such as cranks and hoists, may be used. Additionally, although the pulley 122 of FIG. 1 is depicted at approximately a center of the upper surface of the upper cabinet 104, other positions are also within the scope of the present invention.

The moving system 108 may also be detachably or permanently attached to one or any combination of the front, top, back and side surfaces of the frame 102, as desired.

Figure 9:
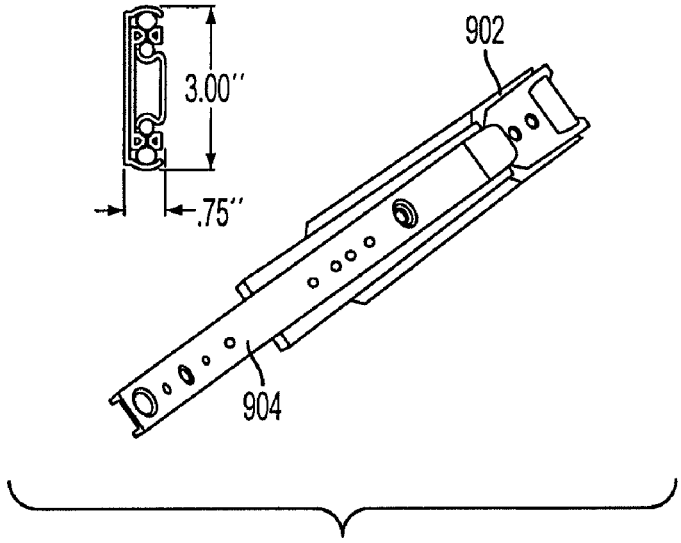
FIG. 9 is an exemplary sliding system.
Figure 10:
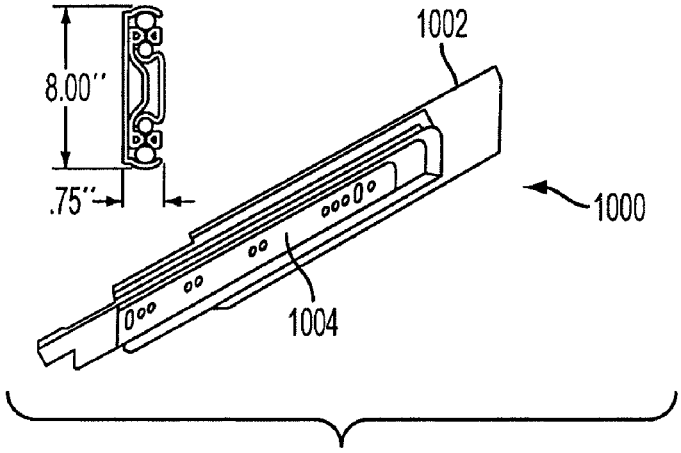
FIG. 10 is another exemplary sliding system.

The sliding system 110 may be drawer-type sliders, such as sliders 900 and 1000 shown in FIGS. 9 and 10, respectively. These sliders are used to support the lower cabinet 106 as the lower cabinet 106 is pulled forward or pushed backward. In the examples of FIGS. 9 and 10, each slider includes a track 902 (or 1002) mounted to an interior side of the frame 102, and a sliding part 904 (or 1004) mounted to a corresponding location on the lower cabinet 106 to cooperate with the track 902 (or 1002). The sliding system 110, such as those in FIGS. 9 and 10, enables the lower cabinet 106 to be easily moved forward and backward. Other types of sliders known to those of skill in the art may be utilized for the sliding system 110.

FIG. 4 shows an exemplary winch system 400 that may be used for the winch device 120 in FIG. 1. Referring to FIG. 4, the winch system 400 may include a tubular motor 402, a tube 404 and a fastening element 406. The tubular motor 402 is attached to the tube 404 to form a bar. The tube 404 and an outer layer of the tubular motor 402 may be made of any suitable material such as polymer (PVC) or metal. The bar formed by 402 and 404 is fastened to the side surfaces or top surface of the frame 102 in FIG. 1 using fastening elements 406. Each of the fastening elements 406 may include, for example, a nut and bolt assembly 408.

Figure 5C:
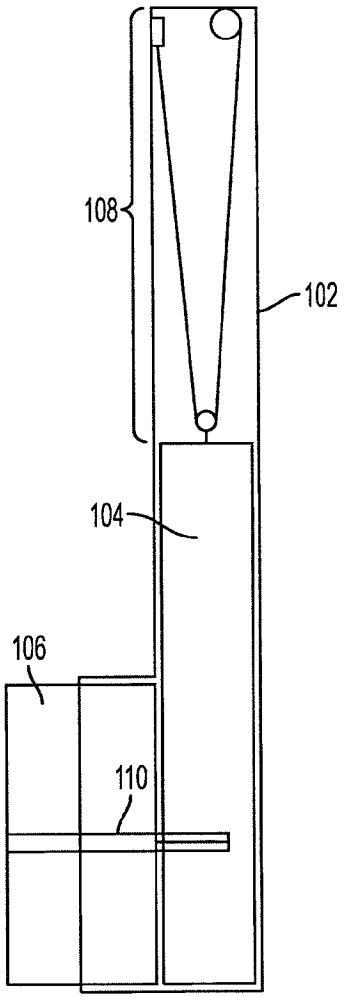
FIGS. 5(*a*)-5(*c*) illustrate various positions of the upper and lower cabinets inside the furniture system 100 using an exemplary pulley lifting system.
Figure 5B:
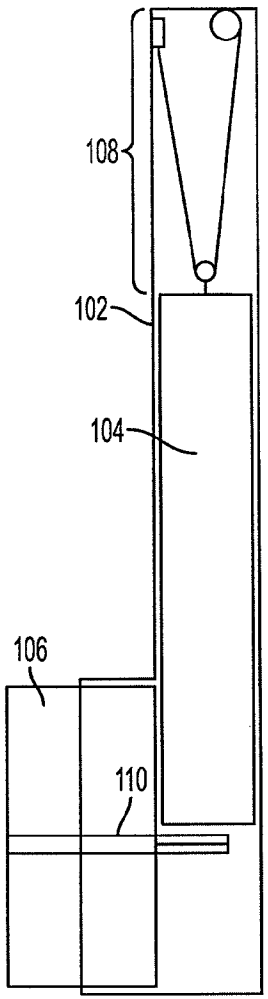
Figure 5A:
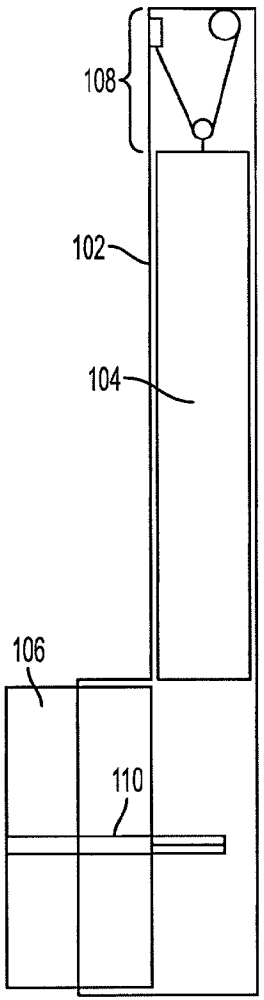

FIGS. 5(*a*)-5(*c*) show various positions of the furniture system 100 of FIG. 1. FIG. 5(*a*) shows the lower cabinet 106 being pulled forward a sufficient amount such that the upper cabinet 104 may be lowered. FIG. 5(*b*) shows the upper cabinet 104 being partially lowered. As shown in FIG. 5(*b*), the upper cabinet 104 can easily be lowered into the space within the frame 102 previously occupied by the lower cabinet 106. FIG. 5(*c*) illustrates the upper cabinet 104 in a fully lowered position. By lowering the upper cabinet 104, the uppermost area of the upper cabinet 104 may be accessed as desired, without a ladder. The uppermost area of the upper cabinet 104 is preferably at least 68 inches above the floor. Although not shown, the upper cabinet 104 may be raised again and the lower cabinet 106 may be returned to its original position when desired.

The illustrations in FIGS. 5(*a*)-5(*c*) show that the opening (or pull-forward) of the lower cabinet 106 enables the lowering of the upper cabinet 104, and the raising of the upper cabinet 104 enables the retraction of the lower cabinet 106.

Figure 6:
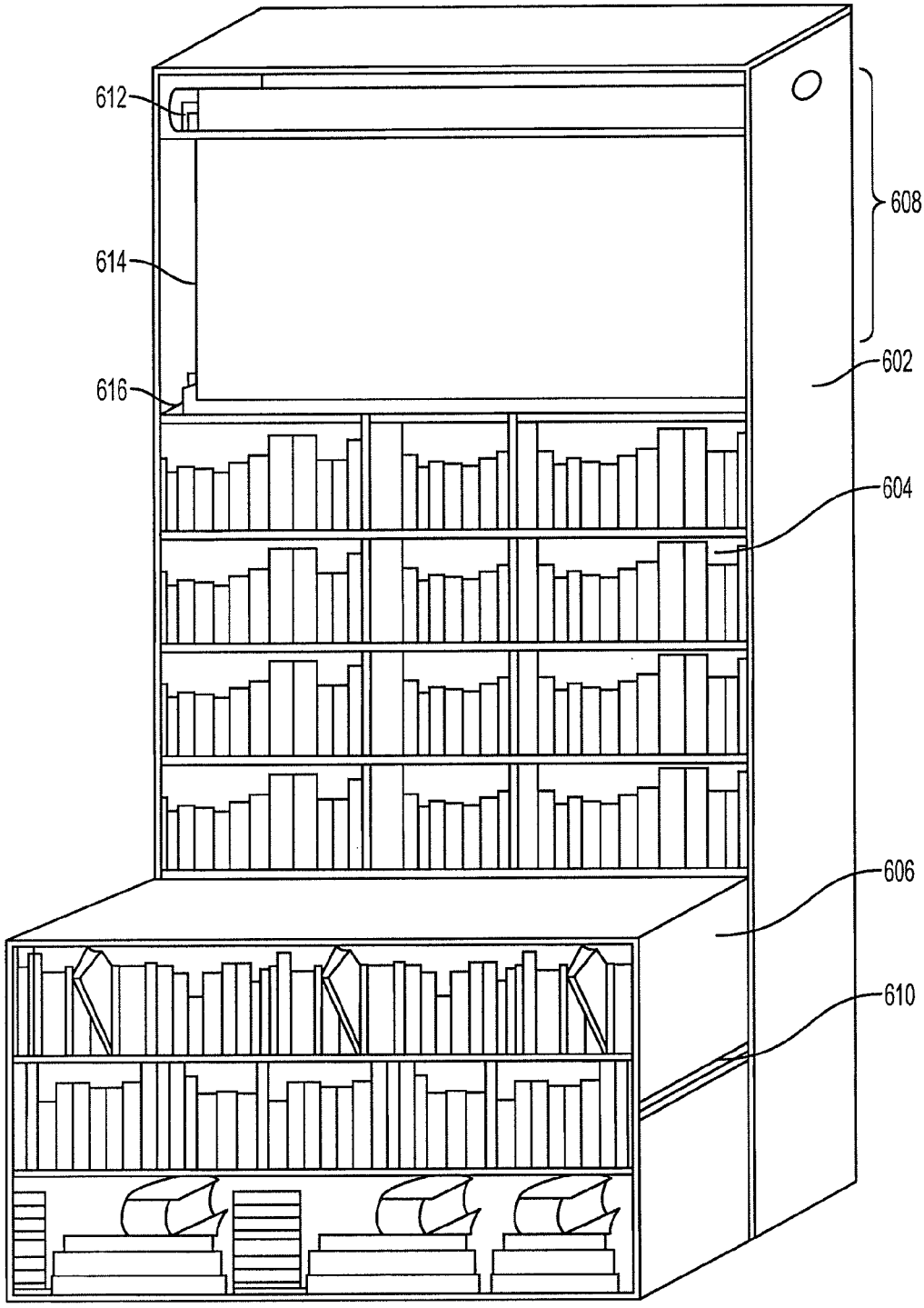
FIG. 6 is a front view of the exemplary embodiments of FIGS. 1 and 5(*a*)-5(*c*)

FIG. 6 provides a front view of a furniture system 600 according to another exemplary furniture system of the present invention. Similar to the furniture system 100 of FIG. 1, the furniture system 600 includes a frame 602, an upper cabinet 604, a lower cabinet 606, a moving system 608 and a sliding system 610. The moving system 608 includes a winch device 612, a suspending system 614, and a leverage element 616. The suspending system 614 may include cables or a sheet of durable plastic or the like. In FIG. 6, the upper cabinet 604 and the lower cabinet 606 are used as bookshelves and have the same depth. In addition, the lower cabinet 606 is pulled forward and the upper cabinet 604 is in a lowered position.

In FIGS. 1, 5(*a*)-5(*c*) and 6, the moving system 108 and the sliding system 110 are shown as two separate systems. Alternatively, the moving system 108 and the sliding system 110 may be interconnected such that a forward movement of the lower cabinet 106 will cause a lowering movement of the upper cabinet 104, and a raising movement of the upper cabinet 104 will cause a backward movement of the lower cabinet 106.

Other alternative moving systems known to those skilled in the art, such as a counterweight system, may be used to raise and lower the upper cabinet 104. These alternative systems are within the scope of this invention.

Figure 7:
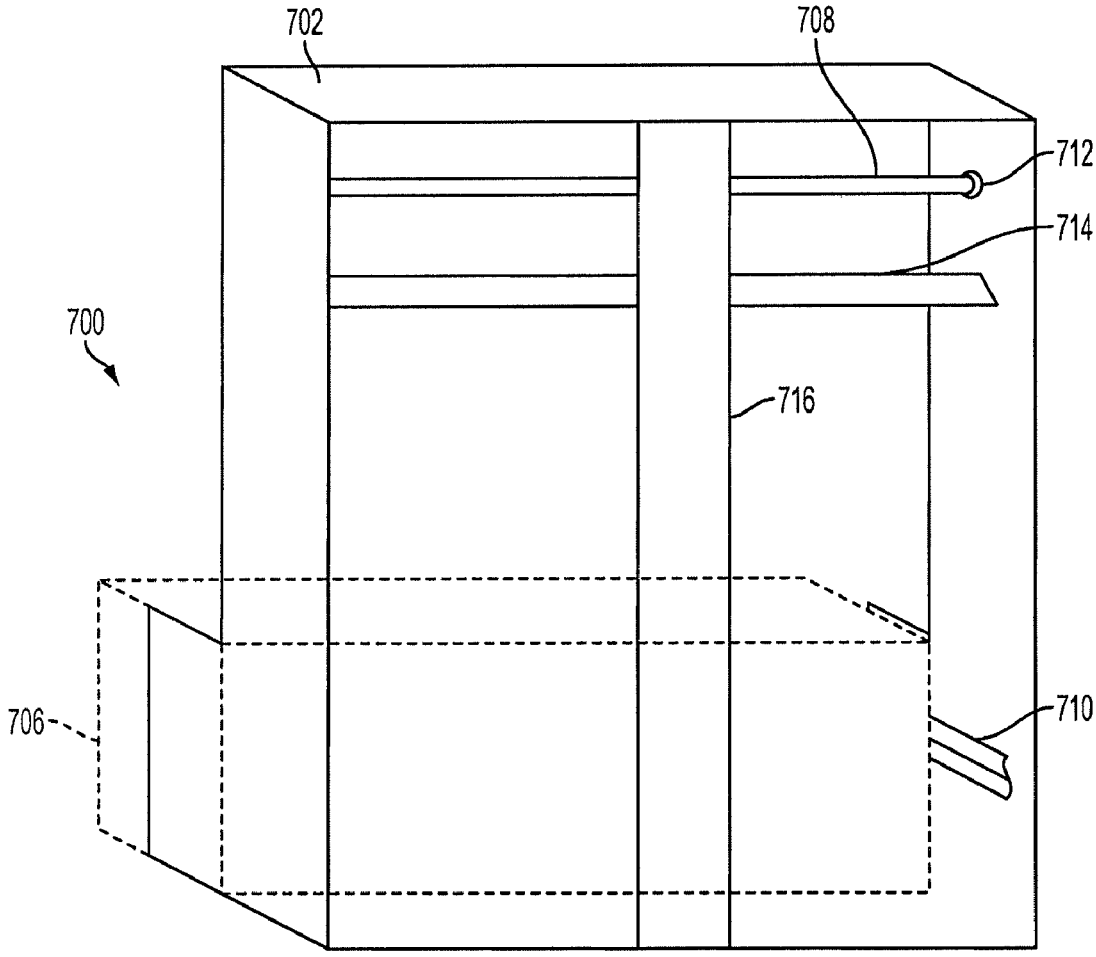
FIG. 7 is a back view of a frame according to another aspect of the present invention.

FIG. 7 shows a back view of a furniture system 700 according to another exemplary embodiment of the invention. The furniture system 700 includes a frame 702, an upper cabinet 704 (not shown) and a lower cabinet 706. The upper cabinet 704 and the lower cabinet 706 may be similar to those in FIG. 1. The furniture system 700 in FIG. 7 further includes a lifting device 708, drawer-type sliders 710, a tilt stop 714, and a vertical sliding guide 716.

The drawer-type sliders 710 in FIG. 7 is attached to the frame 702 and the lower cabinet 706 in order to assist the lower cabinet 706 in being pulled forward or retracted into the frame 702. Other objects, such as wheels or castors (not shown) on the lower cabinet 706 may be used as an alternative or in combination with the drawer sliders 710 to assist with its movement. The dashed lines in FIG. 7 represent the position of the lower cabinet 706 after it has been pulled forward.

The lifting device 708 has a tubular shape and is attached to two sides of the frame 702 by fastening elements 712. The lifting device 708 may include a motor, such as the winch system 400 in FIG. 4, or a counterweight system.

The tilt stop 714 includes a bar attached horizontally across the back of the frame 702. The tilt stop 714 is attached to the frame 702 to prevent the upper cabinet 704 (not shown) from tilting when the upper cabinet 704 is raised and lowered.

Figure 14B:
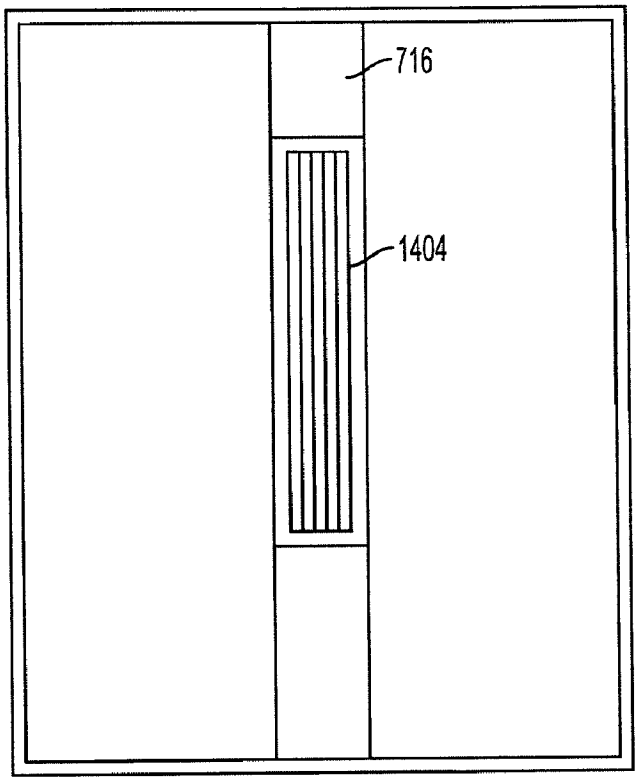
FIGS. 14(*a*) and 14(*b*) are additional non-limiting illustrations of slide guides according to exemplary aspects of the present invention.
Figure 14A:
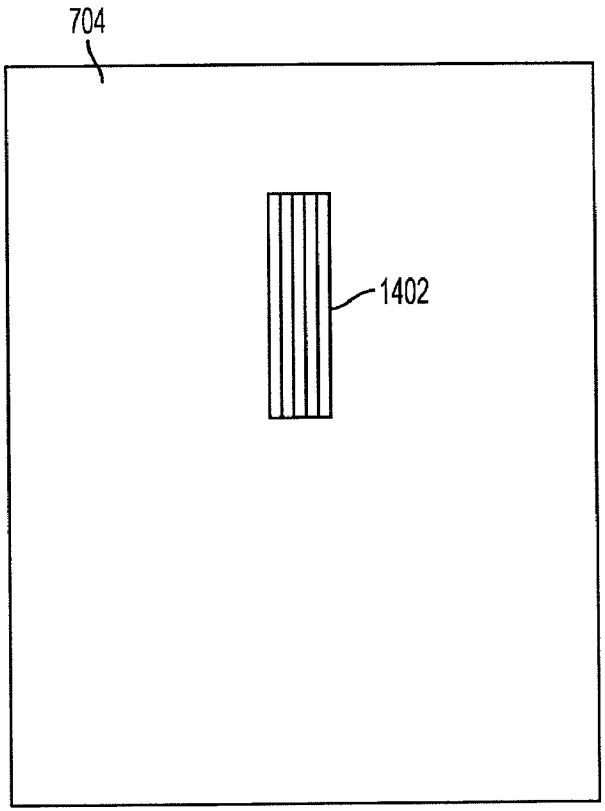

The vertical sliding guide 716 is also attached to the back of the frame 702 to stabilize the raising and lowering of the upper cabinet 704. As shown in FIG. 7, the sliding guide 716 is a panel mounted vertically to the back of the frame 702, approximately at the middle point between the two sides of the frame 702. The slide guide 716 may also be made in any form known to those skilled in the art, including both raised and recessed forms. The upper cabinet 704 may have a corresponding raised or recessed sliding guide, if desired, so that the upper cabinet 704 and the sliding guide 716 may cooperatively engage while raising and lowering the upper cabinet 704. FIGS. 14(*a*) and 14(*b*) provide non-limiting illustrations of an exemplary sliding guide including a slider 1402 (FIG. 14(*a*)) and a corresponding track 1404 (FIG. 14(*b*)). The slider 1402 in FIG. 14(*a*) may be attached to the back surface of the upper cabinet 704 and the track 1404 in FIG. 14(*b*) may be attached to the vertical back panel 716 of the frame 702. The slider 1402 fits inside the track 1404 to support the moving of the upper cabinet 704. Although FIGS. 14(*a*) and 14(*b*) show only one sliding guide, more than one sliding guide may be used for supporting the lowering and raising the upper cabinet 704. The positioning and arrangement of these sliding guides is for illustration purposes, and the sliding guides may be in any position deemed suitable.

Figure 8:
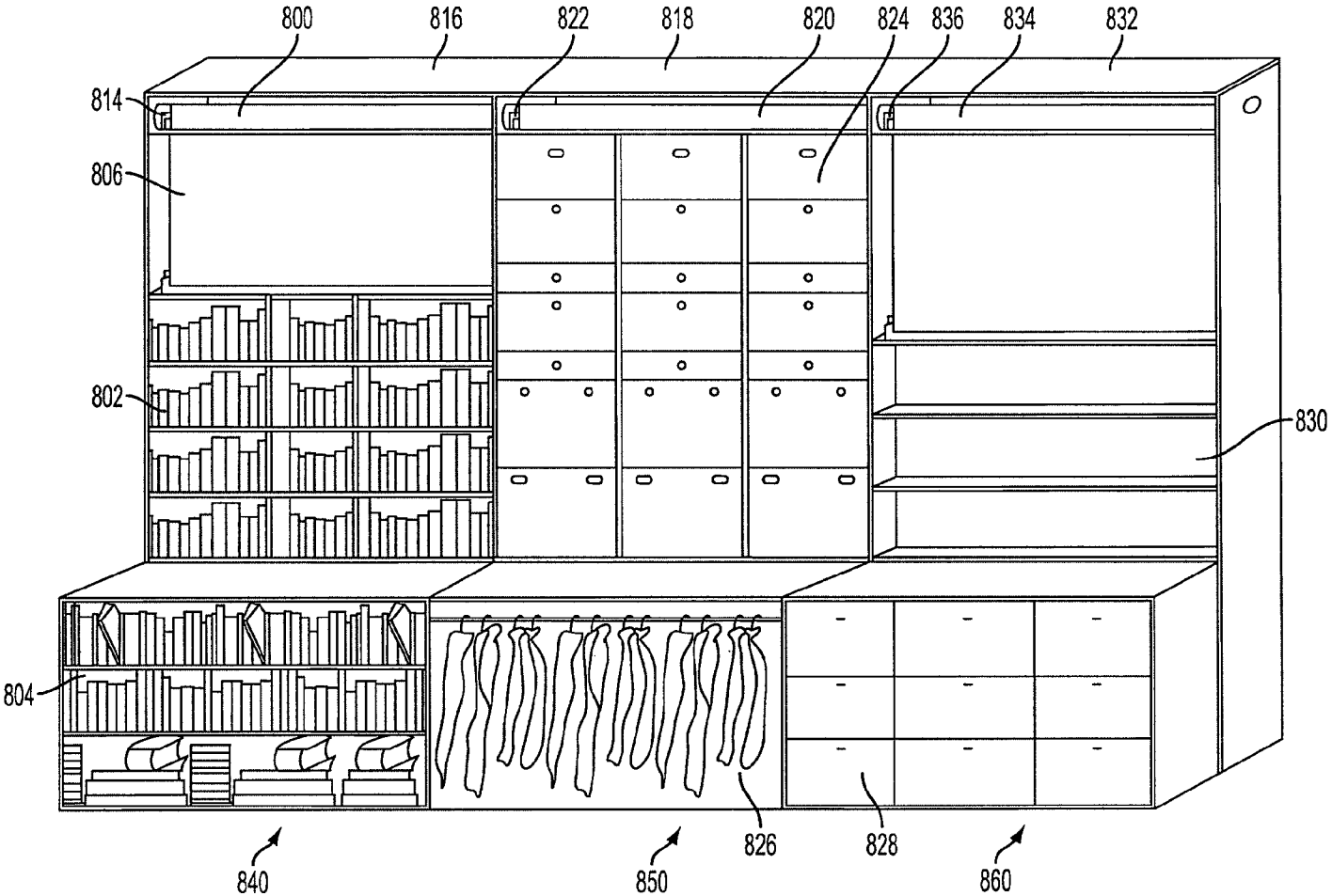
FIG. 8 is a front view of another exemplary embodiment of the present invention.

A plurality of the furniture systems 100 of FIG. 1 may be made and positioned next to each other. For instance, FIG. 8 shows a furniture system including three furniture systems 840, 850 and 860 positioned adjacent each other, wherein each of the furniture systems 840, 850, and 860 is similar to the system 100 of FIG. 1. FIG. 8 demonstrates that the furniture systems of the present invention have nearly unlimited uses. For example, the first system 840 includes a frame 816, an upper cabinet 802 and a lower cabinet 804. In the first system 840, the upper cabinet 802, which is illustrated in a lowered position and suspended on a cable 806, is used as a bookshelf. Likewise, the lower cabinet 804 is used as a bookshelf. A winch system 800, which may be affixed to the frame 816 by a fastening element 814, may be used to raise and lower the upper cabinet 802.

The second system 850 includes a frame 818, an upper cabinet 824 and a lower cabinet 826. In the second system 850, frame 818 is positioned adjacent to the frame 816 of the first system 840. The upper cabinet 824 is illustrated as a filing system, while the lower cabinet 826 is illustrated as a hanging closet area. A winch system 820, which is affixed to the frame 818 by a fastening element 822, may be used to raise and lower the upper cabinet 824.

Finally, the third system 860 includes a frame 832, an upper cabinet 830 and a lower cabinet 828. The frame 832 is positioned adjacent to frame 818 of the second system 850. The upper cabinet 830 is functioning as shelving, while the lower cabinet 828 is adapted to function as filing cabinets. The upper cabinet 830 is illustrated in FIG. 8 in a lowered position. A winch system 834, which is affixed to the frame 832 by fastening element 836, may be used to raise and lower upper cabinet 830 as desired.

Although not illustrated, any of the frames described as part of the furniture system may be securely attached to a wall, if desired. Conventional attachment methods known to those of skill in the art may be used. For example, the frame may be affixed using any type of screws, preferably to a stud or other secure wall feature.

Figure 11C:
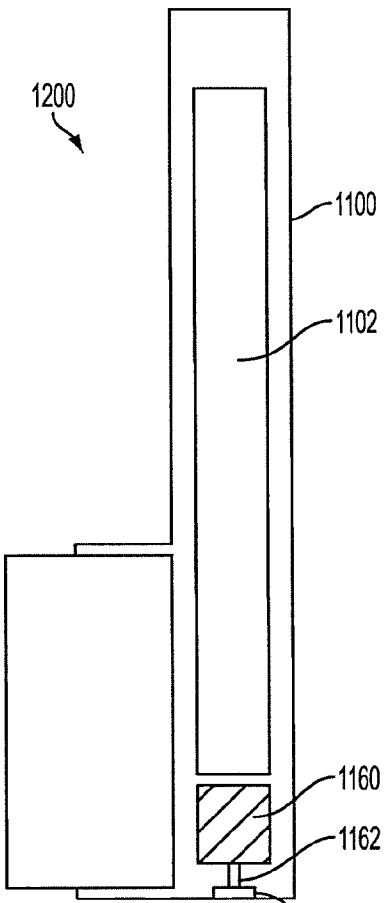
FIGS. 11(*a*), 11(*b*), and 11(*c*) are a furniture system according to another embodiment of the present invention.
Figure 11B:
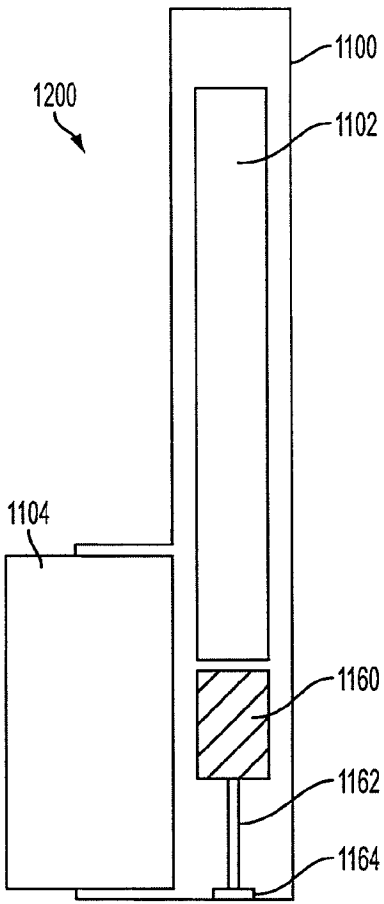
Figure 11A:
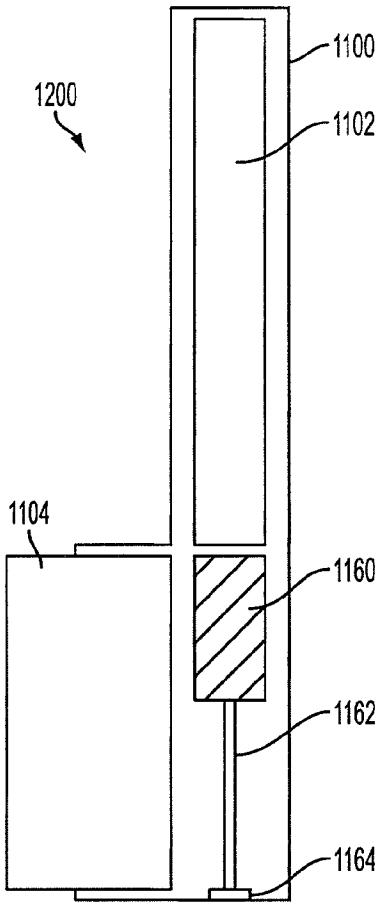

FIGS. 11(*a*)-11(*c*) and 12 illustrate a furniture system 1200 according to yet another exemplary embodiment of the present invention. The furniture system 1200 in FIGS. 11(*a*)-11(*c*) and 12 include a frame 1100, an upper cabinet 1102 and a lower cabinet 1104. The furniture system 1200 in FIGS. 11(*a*)-11(*c*) further includes a lifting system mounted to the bottom part of the upper cabinet 1102 for raising and lowering the upper cabinet 1102. The lifting system includes a pressing cylinder 1160, a piston 1162, and a base 1164. The lifting system may be secured to the frame or floor using the base 1164 and any suitable means for securing such as screws, bolts, nails, etc. The pressing cylinder 1160 may be gas, hydraulic, electrical, mechanical, or any other suitable type known in the art.

In FIG. 11(*a*), the upper cabinet 1102 is in a fully raised position. FIG. 11(*b*) illustrates the upper cabinet 1102 partially lowered by the pressing cylinder 1160 within the frame 1102. The lower cabinet 1104 is in a partially pulled-out position, so that the upper cabinet 1102 may be lowered. FIG. 11(*c*) shows the upper cabinet 1102 in a fully lowered position. If the lifting system is mounted to the bottom of the upper cabinet 1102 as shown in FIG. 11(*a*), the lower cabinet may be in a permanently or semi-permanently extended state, if desired.

Figure 12:
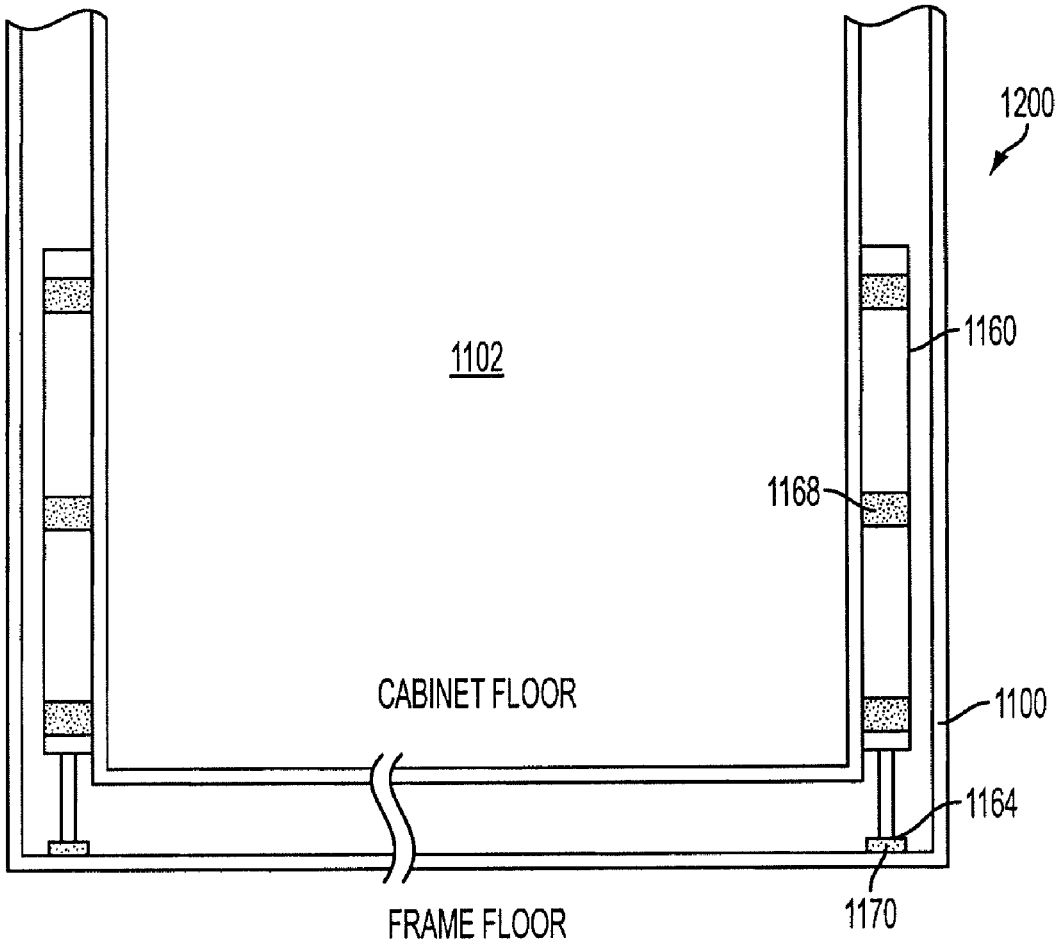
FIG. 12 illustrates another exemplary attachment position of the lifting system shown in FIGS. 11(*a*)-11(*c*)
Figure 13C:
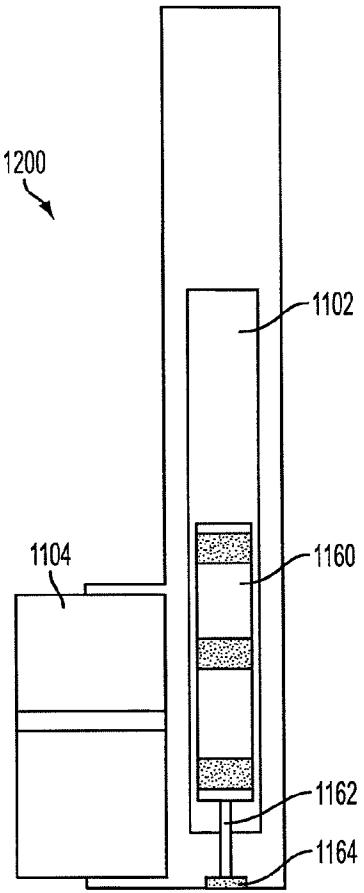
FIGS. 13(*a*)-13(*c*) are side views of the furniture system shown in FIG. 12.
Figure 13B:
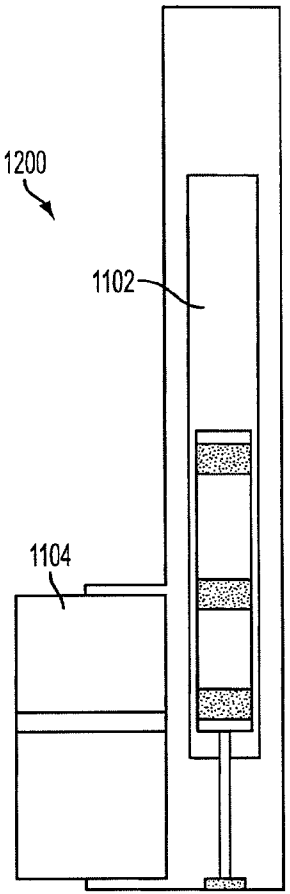
Figure 13A:
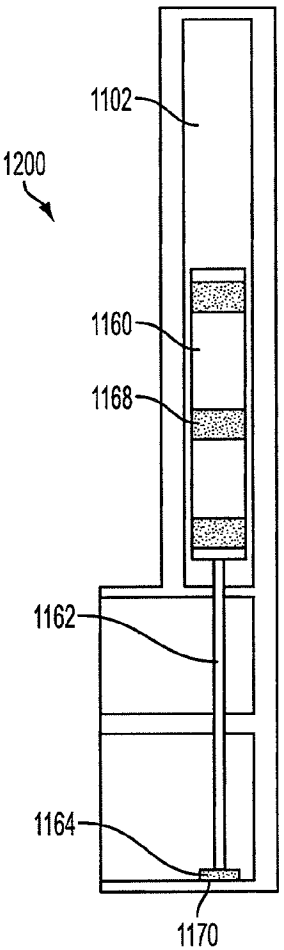

FIG. 12 shows a back view of the furniture system 1200 according to another exemplary embodiment of the invention. The furniture system 1200 of FIG. 12 is similar to that of FIG. 11(*a*) except, in FIG. 12, the lifting system is mounted to the sides, rather than the bottom, of the upper cabinet 1102. In FIG. 12, the pressing cylinders 1160 are secured to the sides of the upper cabinet 1102 by fastening elements 1168. The base 1164 of the piston 1162 may be secured to the floor or the frame 1100 by fastening elements 1170. The fastening elements 1168 and 1170 can be screws, bolts, clamps, nails, etc. FIGS. 13(*a*)-13(*c*) illustrate a side view of the furniture system 1200 with the cylinders being mounted to the sides of the upper cabinet 1102. FIG. 13(*a*) shows the upper cabinet 1102 being fully raised by the lifting system and the lower cabinet 1104 being fully retracted to the back of the frame 1102. FIG. 13(*b*) shows the lower cabinet 1104 being pulled forward and the upper cabinet 1102 being partially lowered by the lifting system 1160-1164. FIG. 13(*c*) shows the upper cabinet 1102 being fully lowered by the lifting system 1160-1164.

Although the lifting system is illustrated in specific positions for ease of reference in FIGS. 11(*a*)-11(*c*) and 12, this positioning is for illustrative purposes only and is not limiting of the invention. All suitable positions are within the scope of the present invention.

Each of the non-limiting embodiments described above may include safety stops (not shown) at appropriate positions to prevent accident or injury to a user.

By way of further non-limiting example, an upper cabinet according to the present invention may have a height of approximately 70 inches. A corresponding lower cabinet may have a height of approximately 40 inches. A winching system may occupy the remaining approximately 6-10 inches in a frame built to occupy a room having a 10-foot ceiling.

The respective depths of the upper and lower cabinets may be developed as desired. In one example, an upper cabinet may have a depth of approximately 10 inches if it is to be used as a bookcase. Alternatively, if the upper cabinet is to be used as a kitchen pantry, it may have a depth of 6 inches. Optionally, the lower cabinet may have a depth of approximately 33 inches.

Although the term "cabinet" is used to describe the upper and lower cabinets throughout the foregoing non-limiting description, it is important to note that these elements may be any article or type of furniture. In addition, the present invention is not limited to the articles of furniture selected. For example, the lower interior element may include a chest of drawers, while the upper cabinet may be a set of shelves. Alternative configurations include any combinations of drawers, shelves, or other furniture, including, but not limited to, desks, couches, gym equipment, cabinets, chairs, tables, entertainment centers, as well as all articles of furniture known to those skilled in the art.

The present invention may also include, as an optional feature, an alarm system to indicate any number of undesirable conditions. For example, the alarm system may be configured to warn that an obstruction is blocking the upper cabinet from ascending or descending. The obstruction may be a person's hand, the lower cabinet, or anything else in the way of the upper cabinet. The alarm system may also be configured to warn that the descent or ascent of the upper cabinet is not operating properly. Of course, these conditions are merely examples and any condition within the knowledge of one of skill in the art may be included.

Although the illustrated non-limiting embodiments do not show cabinet doors as a front part of the frame, doors or any decorative furniture elements may be included as desired. For example, any of frames 816, 818, and 832 in FIG. 8 may include a front door or doors as an aspect of the system. In an embodiment where the lower cabinet has an equal depth to the upper cabinet, a single door may be used to cover a front of these frames. Alternatively, any combination of any different number of doors may be used as desired. Other decorative features, such as glass covers, may also be used if desired.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

I claim:

1. A furniture system, comprising:

a frame having an upper portion and a lower portion;

at least one upper article of furniture located in the upper portion of the frame;

at least one lower article of furniture located in the lower portion of the frame and underneath the at least one upper article;

a moving system attached to the frame and the at least one upper article for moving the at least one upper article vertically within the frame; and a sliding system attached the at least one lower article to the frame for moving the at least one lower article forward and backward, wherein:

a forward movement of the at least one lower article enables the at least one upper article to move down from the upper portion to the lower portion of the frame and a rising movement of the at least one upper article from the lower portion to the upper portion of the frame enables the at least one lower portion to move backward, the upper portion of the frame is higher than 68 inches, the moving system comprises a lifting system having a pressing cylinder, a piston, and a base, and the lifting system is attached to a bottom of the at least one upper article.

* * * * *